United States Patent [19]

Brimeyer et al.

[11] Patent Number: 4,807,461

[45] Date of Patent: Feb. 28, 1989

[54] MOTOR GRADER MAIN FRAME

[75] Inventors: Dennis A. Brimeyer; David W. Stubben, both of Dubuque, Iowa

[73] Assignee: Deere & Company, Moline, Ill.

[21] Appl. No.: 821,427

[22] Filed: Jan. 21, 1986

[51] Int. Cl.[4] ..... E02F 3/76

[52] U.S. Cl. ..... 172/793; 52/731; 172/745

[58] Field of Search ..... 172/745, 776, 781, 788, 172/789, 791, 792, 793, 795, 796, 797; 403/271, 272, 375; 280/797; 52/98, 731; 29/155 R; 228/138, 182; 180/311; 414/722, 727

[56] References Cited

U.S. PATENT DOCUMENTS

| | | | |
|---|---|---|---|
| 3,327,413 | 6/1967 | Brinkmeyer et al. | 172/793 X |
| 3,454,110 | 7/1969 | Hanser | 172/793 |
| 3,739,861 | 6/1973 | Johnson et al. | 172/793 |
| 4,034,876 | 7/1977 | Yancey | 414/786 |
| 4,064,947 | 12/1977 | Cole | 172/781 |
| 4,071,090 | 1/1978 | Easterling | 172/788 |
| 4,185,700 | 1/1980 | Atherton et al. | 172/796 |
| 4,260,322 | 4/1981 | Cameron | 52/731 X |
| 4,340,119 | 7/1982 | MacDonald | 172/789 |
| 4,364,438 | 12/1982 | Pyle | 172/789 |
| 4,428,173 | 1/1984 | Knell | 52/731 |
| 4,696,350 | 9/1987 | Ruhter et al. | 172/793 |

FOREIGN PATENT DOCUMENTS

| | | | |
|---|---|---|---|
| 2048531 | 3/1971 | France . | |
| 2438094 | 9/1979 | France . | |
| 60-123633 | 2/1985 | Japan . | |
| 1052634 | 11/1983 | U.S.S.R. | 52/731 |
| 719728 | 12/1954 | United Kingdom . | |

*Primary Examiner*—Richard T. Stouffer
*Attorney, Agent, or Firm*—Henderson & Sturm

[57] ABSTRACT

A main frame construction for a motor grader wherein the main frame comprises a rear unit, a center unit, and a front unit. Both rear and center units are box-like structures in cross sections with constant transverse dimensions, with constant metal specification, with continuous welds at all four corners running longitudinally of each unit, with but one weld junction at a location spaced rearwardly of the knee area supporting a saddle structure for the blade, and without the provision of extra structural members and arrangements at the knee area. Minimum section changes within the box structures of the rear and center units, the elimination of weld starts and stops provides a strong smooth section of main frame alleviating locally high stresses at the knee area for mounting the saddle. The very simplicity of the rear and center unit box-structure as described and depicted is the heart of the improved main frame.

Further, the provision of weld spaced at each corner of the box frames, with a pair of weld spaces on each side thereof enables continuous and simultaneous welding of each pair of side weld spaces by a one pass process.

2 Claims, 4 Drawing Sheets

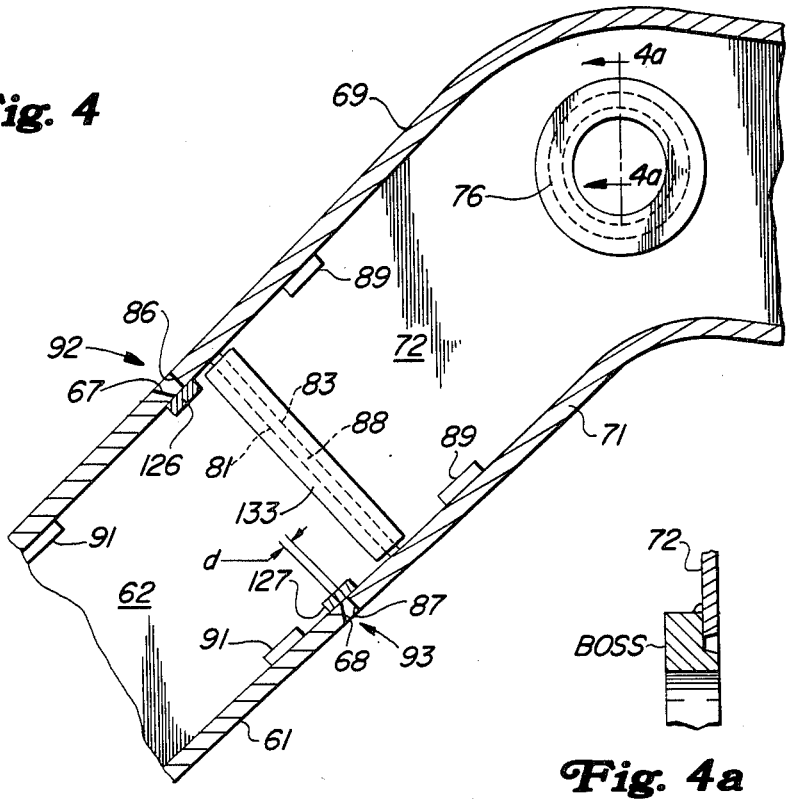
Fig. 4
Fig. 4a
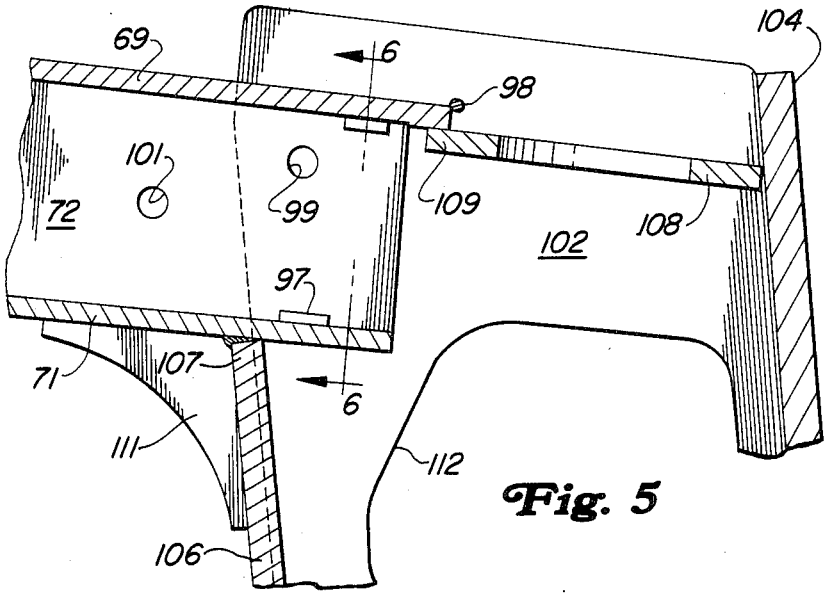
Fig. 5

MOTOR GRADER MAIN FRAME

ASSIGNMENT

The entire right, title and interest in and to this application and all subject matter disclosed and/or claimed therein, including any and all divisions, continuations, reissues, etc., thereof are, effective as of the date of execution of this application, assigned, transferred, sold and set over by the applicants named herein to Deere & Company, a Delaware corporation having offices at Moline, Ill. 61265, U.S.A., together with all rights to file, and to claim priorities in connection with, corresponding patent applications in any and all foreign countries in the name of Deere & Company or otherwise.

Technical Field

This invention relates to articulated motor graders and more particularly to the main frame of a motor grader; which main frame is pivotally connected at its rear end to an engine frame, carries an operator's station at its rear, supports a saddle unit centrally thereof for an earth moving blade, and has its front end mounted on front wheels.

Background Art

Conventionally, an articulated motor grader is comprised of fore-and-afte extending main frame supported forwardly on wheels. The rear portion of the main frame is articulately connected to a tractor or engine frame supported on traction wheels. At the rear end of the main frame an operator's station is mounted, with the front end thereof supported on wheels. Intermediate the ends of the main frame, a saddle structure is customarily mounted for suspendably supporting a ground-engaging blade through a linkage capable of angularly adjusting and laterally positioning the blade. A drawbar is pivotally mounted at one end to the forward section of the main frame and at the other end to the saddle structure linkage.

During the grading operation, blade loads are transmitted to the drawbar. The drawbar, being swivelably mounted to the front, transmits axial, horizontal, and vertical loads to the forward section of the main frame. The drawbar, also being restrained at the rear by the linkage, transmits vertical and horizontal loads through the linkage and saddle and into the main frame. The main frame is, therefore, in the saddle mounting area, subject to combined vertical, horizontal and torsional bending.

It has been customary to weld a saddle structure or mounting parts to the main frame for the purpose of mounting the linkage. This added structure interrupts the uniformity of the main frame section. This section change combined with notches and heat affected zones associated with the extra welds results in excessive local stress levels when loads are applied. These stress levels, if not reduced through extraordinary design and manufacturing efforts, will result in low hour fatigue failure.

It has been a common practice to reduce these stresses to acceptable levels by adding a significant amount of reinforcement to the saddle area, carefully shaping reinforcement parts to reduce the abruptness of the resulting section changes and grinding edges of reinforcements and welds. The use of these techniques represent a substantial additional cost and, in some circumstances, unwanted additional vehicle weight.

DISCLOSURE OF THE INVENTION

This invention comprises the provision of an improved main frame comprising a rear unit for supporting the operator's station, a center unit joined to the rear unit and supporting a saddle structure for an earth moving blade, and a front unit joined to the center unit and supported by wheels. The rear and center units, other than certain elements secured thereto for purposes other than structural strength, comprise in cross section a box-like structure made up of upper and lower plates and a pair of transversely spaced side plates, all plates having the same composition or specification of metal, although not necessarily. The outer transverse dimension of the rear and center box units are identical. The inner transverse dimensions of the rear and center box units are identical except for locations around saddle mounting holes where round bosses are used to increase bearing area to properly support loads applied to front and rear saddle mounting pins. Changes of height dimensions of the rear box unit and particularly the center box unit, which contains the important knee area where the saddle structure is mounted are gradual and smooth. Abrupt section changes which result in locally damaging stresses which would contribute to significantly reduce the fatigue life of the main frame are eliminated.

Furthermore, continuous welds are formed longitudinally at each corner of the box-like structure along both rear and center units, the weld space at each corner having a wedge shape, this providing a groove geometry to assure a flush full penetration weld through the thickness of the steel at all such weldments. Further, each weld space is backed up by a portion of the top and bottom steel plate so that the weld material will not blow through. The absence of weld starts and stops, particularaly in areas of nominally high stress, also contributes to the elimination of locally damaging stress levels. The only transverse weld joint in the box section occurs in an area other than where the saddle structure is mounted. The resulting welds are full penetration groove welds backed up with plates to support the weld as it is applied.

Attainment of the above objectives further provide for the transverse welds at the single transverse staggered joint to have acceptable strength and fatigue life due to the fact that at that area of the knee joint, spaced rearwardly of the saddle structure mounting and free of all section changes, extra strengthening plates and stress notches, the nominal strain levels are sufficiently low. These objectives are also achieved by providing properly sized and smooth radii at the knee area of the center unit.

By the provision of the three sub-assemblies of the rear, center and front sections, both smaller and simple weld fixtures for assembling the sub-assemblies may be used and a simpler final weld assembly fixture utilized. Also, machining may be accomplished in the smaller sub-assemblies thereby eliminating the need for a large and complicated machinery fixture to accomplish the machining in the final assembly.

BRIEF DESCRIPTION OF THE DRAWINGS

These and other attributes of the invention will become more clear upon a thorough study of the following description of the Best Mode for Carrying Out the Invention, particularly when reviewed in conjunction with the drawings, wherein:

FIG. 4 is an enlarged sectional view of the juncture of the center and front units of the main frame;

FIG. 4A is an enlarged cross-sectional, fragmentary view as taken along the line 4A—4A in FIG. 4;

FIG. 5 is an enlarged sectional view of the juncture of the rear and center units;

BEST MODE FOR CARRYING OUT THE INVENTION

Figure 1:
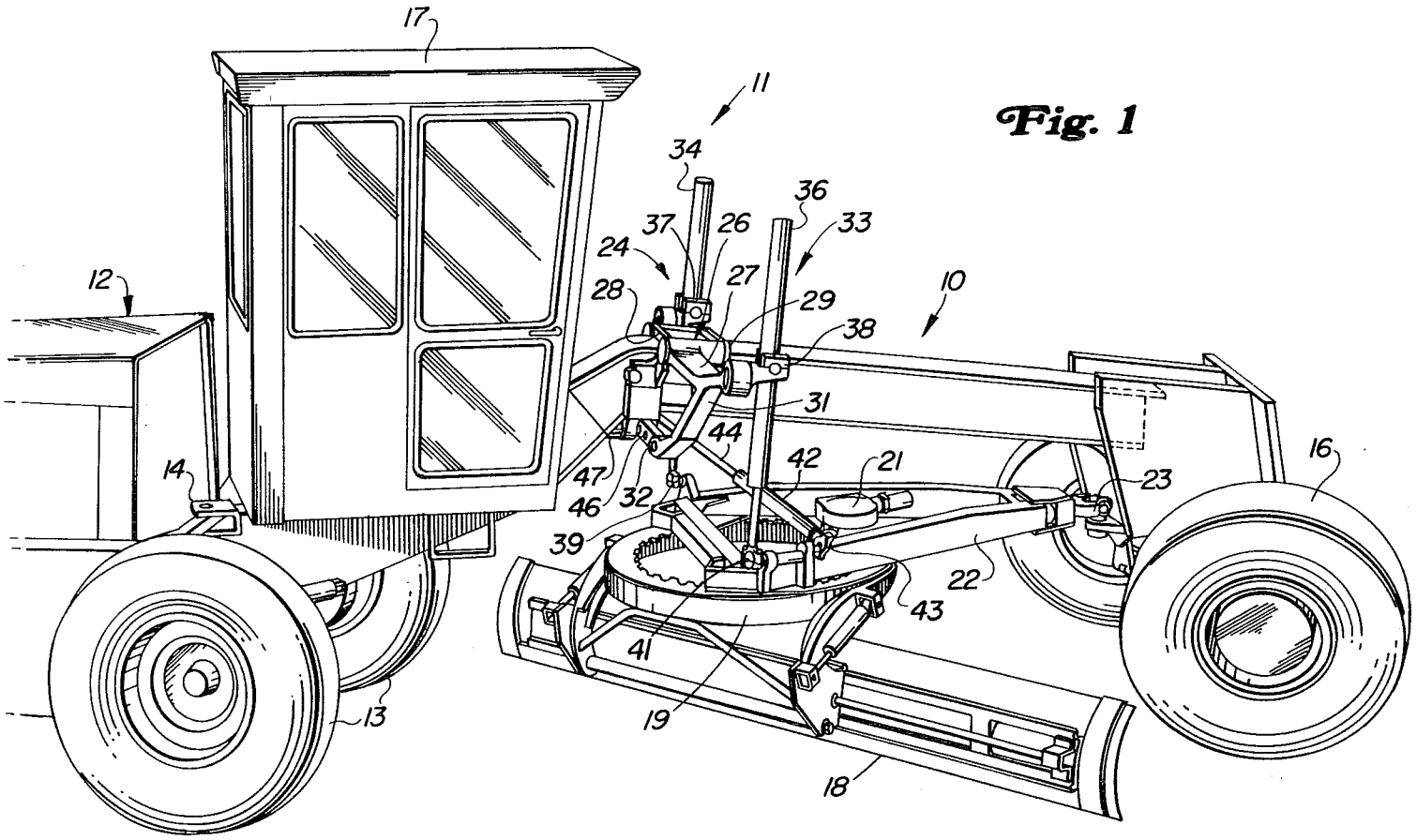
FIG. 1 is a partial side elevational view of a motor grader embodying the main frame of this invention.

Referring to FIG. 1, the main frame of this invention is indicated generally at (10) and is a component of a motor grader, generally indicated at (11), comprised of a rearwardly located tractor (12) supported on wheels (13) and the main frame (10) extending fore-and-aft. The frame (10) is articulately hinged to the tractor (12) at the aft location (14) and supported forwardly by steering wheels (16). An operator's station (17) is supported on the rear portion of the main frame (10). Suitable controls and steering mechanism (not shown) are provided in the operator station (17) so that an operator may operate the various hydraulic units of the motor grader (11) as well as steer the motor grader. Suspended beneath the main frame (10) is a grader blade (18) suitably carried in a conventional manner by a circle (19). The circle (19) carries an internal gear suitably conntrolled for rotation by a hydraulic motor (21) fixably mounted to a drawbar (22). The forward end of the drawbar (22) is swivelably mounted forwardly to the main frame (10) by conventional means such as a universal connector (23).

A saddle structure (24) is mounted to the main frame (10) and includes a pair of generally Y-shaped bell cranks (26) one on each side of the main frame (10), and each of which has a crank arm (27) pivotally mounted to the saddle (24) between saddle end face elements (28) and (29) in a conventional manner. The other crank arm (31) of each bell crank (26) is pinned to one end of a crossbar (32) which extends below the main frame (10).

The grader blade suspension linkage, generally indicated as (33), inclusive of bell cranks (26), and crossbar (32) further includes extensible and retractable hydraulic lift actuators (34) and (36) having cylinder portions swivelably connected to a respective bell crank (26) by respective swivel connectors (37) and (38). The rod portion of lift actuators (34) and (36) are swivelably connected at their ends to drawbar (22) in a transversely spaced apart relationship by any conventional means such as by universal connectors (39) and (41), respectively. Further, an extensible and retractable hydraulic side shift actuator (42) is swivelably mounted to the drawbar (22) at one end by means such as a universal swivel connector (43). The actuator (42) extends generally diagonally transverse from one side of the main frame (10) to the other such that the actuator rod (44) is swivelably connected to an arm (not shown) of a bell crank (26) on the opposite side by means such as universal swivel connector (not shown).

The crossbar (32) has a plurality of fore-and-aft directed apertures (46) formed therein in tranversely spaced apart relationship. A locking pin means (47) such as described in U.S. Pat. No. 3,986,563 is fixably mounted to the saddle (24) for cooperating with the locking pin apertures (46) in the crossbar (32).

The main frame (10) itself comprises generally a rear unit (51) (FIG. 2) adapted for articulation connection to the tractor (12) and for supporting the operator's station (17); a center unit (52) is secured as by welding to the rear unit (51) and supporting the saddle structure (24); and a front unit (53) secured as by welding to the center unit (52) and to which the front wheels (16) are mounted.

Figure 2:
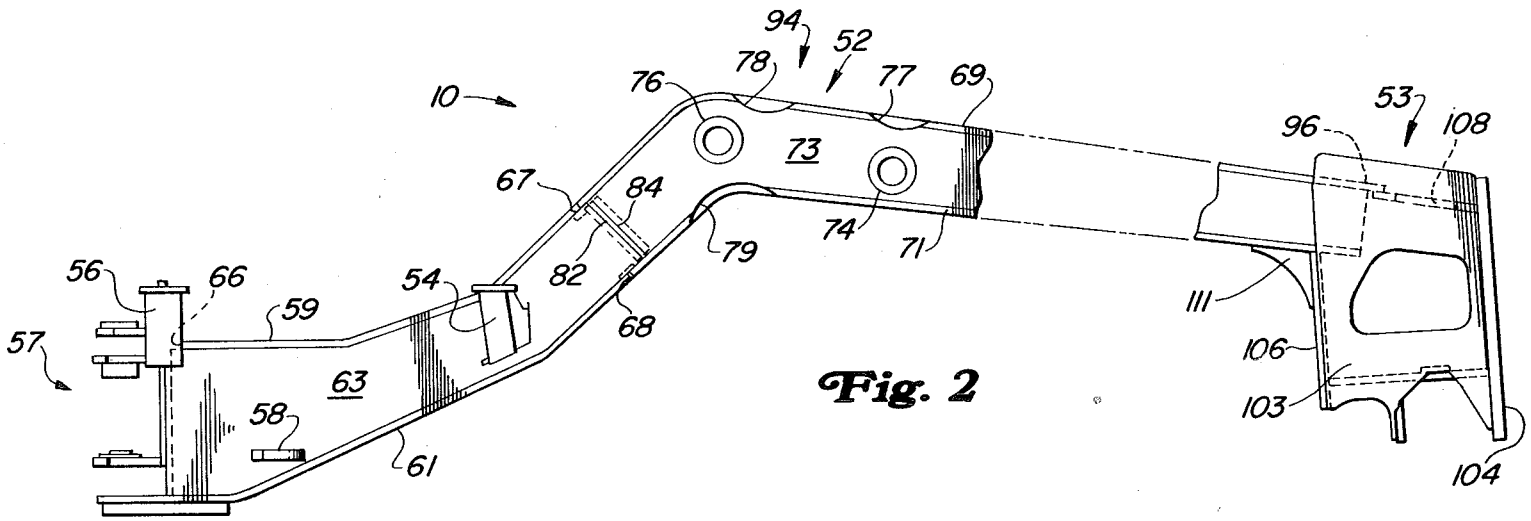
FIG. 2 is a side elevational view of the main frame of FIG. 1.

The rear unit (51) has pairs of fore-and-aft support brackets (54) and (56) mounted thereto for supporting the operator's station or cab (17), is provided with articulation joint plates indicated generally at (57) at the rear thereof; and further has a wing bracket (58) secured on either side thereof for supporting hydraulic structure not a part of this invention. Throughout its cross section, the rear unit comprises an upper plate (59), a lower plate (61), and a pair of transversly spaced left side and right side plates (62) and (63), respectively. The shape in side elevation of the rear unit (51) is best illustrated in FIG. 2 such that from the portion thereof beneath the cab (17), the forward portion thereof extends forwardly and upwardly to the forward end of the rear unit indicated generally at (64). As will be seen hereinafter and referring particularly to FIG. 7, other than the change of vertical relationship between the upper and lower plates (59) and (61), the transverse dimensions of the rear unit (51) are constant throughout its length.

Referring to FIG. 2, the upper plate (59) is beveled at (66) and (67) at its rear and forward ends thereof, with the lower plate (61) beveled at (68) at its front end thereof, the bevels (66-68) providing, as seen hereafter a groove geometry to assure full penetration of the weld material through the upper and lower steel plates (59) and (61), respectively, of the main frame (10). The upper plate bevel (67) and the lower plate bevel (68) at the front ends thereof, respectively, are further more clearly shown in FIG. 4.

Figure 3:
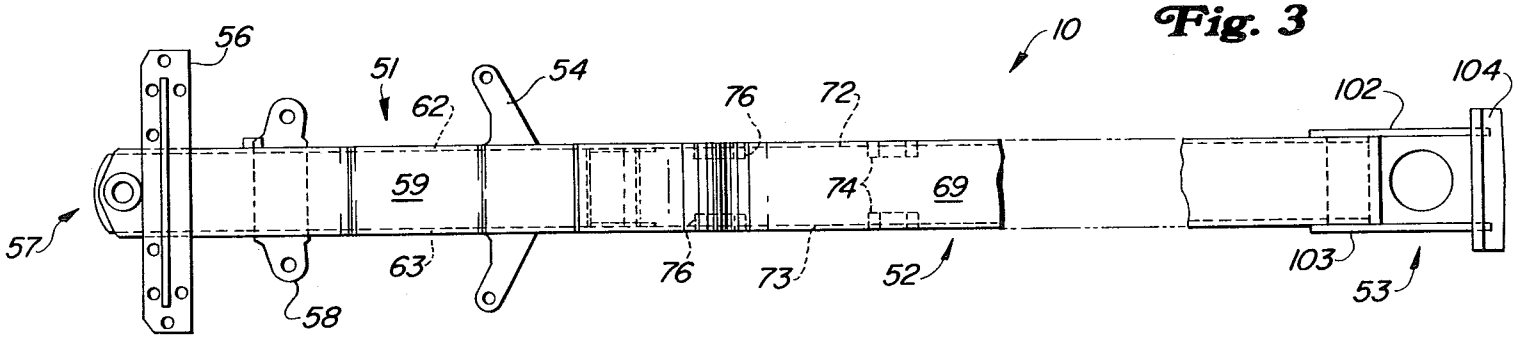
FIG. 3 is a plan view of the main frame.

The center unit (52) comprises an upper plate (69) having the same transverse dimensions as upper plate (59) of the rear unit (51), lower plate (71) which has the same transverse dimensions as lower plate (61), and transversely spaced left and right side plates (72) and (73), also having the same transverse dimensions as the side plates (62) and (63) of the rear unit (51). Transverse pairs of machined and bushed holes (74) and (76) (FIG. 3) are located in the sides of the plates (72) and (73), with milled pads (77), (78) and (79) formed in the sides of the center unit (52), all for the purpose of mounting the saddle structure (24), which arrangement is described in detail in co-pending application Ser. No. 06/780,048, now U.S. Pat. No. 4,696,350 issued Sept. 29, 1987. It should be noted that round bosses (not shown) are welded into the holes (74) and (76) using the same "wedge" space for welding which is described herein (see FIG. 6 and 7) for the corners of the frame units. The round shape used provides for continuous groove and fillet weld around each boss, such that elimination of weld starts and stops is provided, such welds generating high local stresses. Pins (30), only one showing, are inserted through the bosses mounted in the holes (74) and (76) for supporting the saddle (24).

Referring to FIG. 4, it is seen that the rearward ends (86) and (87) of the center unit (52) extend a controlled distance (88) beyond the beveled end (68) of the lower plate (61). Also, the forward end (67) of the upper plate (59) is positioned at a controlled distance forwardly of the beveled end (68) of the lower plate (61). To mate with the forward end (64) of the rear unit (51), the rear ends (83) of the side plates (72) and (73) of the center unit (52) are recessed a controlled distance from the rear end (87) of the lower plate (71). Also, the rearward end (86) of the upper plate (69) is extended a controlled distance from the rear end (87) of the lower plate (71), rear ends (86) and (87) having a straight cut. When the rear of the center unit (52) is aligned with the front of the rear unit (51), a dimension "d" is controlled between plates (61) and (71) as plate shown in FIG. 4; also, the bottom surface of plate (61) is aligned with the bottom surface of plate (71), transversely; one edge of plate (61) is aligned with the adjacent edge of plate (71) to therefore transversely align the front of the rear unit (51) with the rear of the center unit (52).

Thus located, the respective front and rear ends of the rear and center units (51) and (52) are, therefore, positioned together for welding such that a proper spacing at (88) and (92) occurs between the respective forward ends (81), (82) and (59) of the rear unit side plates (62), (63) and top plate (59), and the respective rear ends (83), (84) and (69) of the side plates (72), (73) and the top plate (69) of the center unit (52).

Further, it will be noted that wedge-shaped weld areas (92) and (93) are formed on the upper and lower surfaces of the rear and center units (51) and (52), as best illustrated in FIG. 4, as between the respective pairs of upper and lower plates of the units (51) and (52). The forming of these weld areas (92) and (93) as to their spacing is controlled in the same manner as between ends (81) and (83). The wedge shape of these spaces (92) and (93) discloses a diverging groove geometry thereof which will give a full penetration weld for maximum strength and durability. Furthermore, it will be noted that the joint at (64) between the front end of the rear unit (51) and the rear end of the center unit (52) spaced rearwardly and away from the important knee area indicated generally at (94) in FIG. 2, of the main frame (10) wherein the saddle structure (24) is mounted.

Referring to FIG. 5, the forward end of the center unit (51) is illustrated, the upper plate (69) having a front end (96) extended forwardly more than the front end of the lower plate (71) for securement purposes to the front unit (53). Holes (99) and (101) provided in the sides of the center unit side plates (72) and (73) for the passage there-through of hydraulic lines (not shown). As was the situation with the rear unit (51), other than a slight variation in the vertical spacing between the upper and lower plates (69) and (71) of the center unit (52), a transverse spacing between the left and right side plates (72) and (73) thereof is constant throughout the length of the center unit (52). Furthermore, although not necessarily so limited, the specification as to metal for all upper, lower and side plates of the rear and center units (51) and (52) remains the same throughout the length of both units, and it will be noted that no additional metal is provided in conjunction with the rear and center units (51) and (52), respectively, for structural purposes. Thus, minimal cross section changes in the main frame in the important area, particularly, of the knee joint (94) are provided. This will be seen more clearly hereinafter from the description of the weldments for the rear and center units (51) and (52) by reference to FIG. 6 and 7.

The front unit (53) as best shown in FIGS. 2 and 5 comprises a pair of transversely spaced side plates (102) and (103) adapted for mounting on the front wheels (16), a front plate (104) to which optional equipment (not shown) may be mounted, a rear plate (106) the upper end (107) of which supports the front end of the center unit (52), an upper plate (108) reinforces the top of the front unit (53) with an opening formed therein to allow passage of hydraulic hoses (not shown). Gussets (111) are secured between the rear of the rear plate (116) and the bottom of the center unit to strengthen the joint between the front (51) and center units (52), and an opening (112) is provided in the side plates (102) and (103) for servicing purposes.

Figure 6:
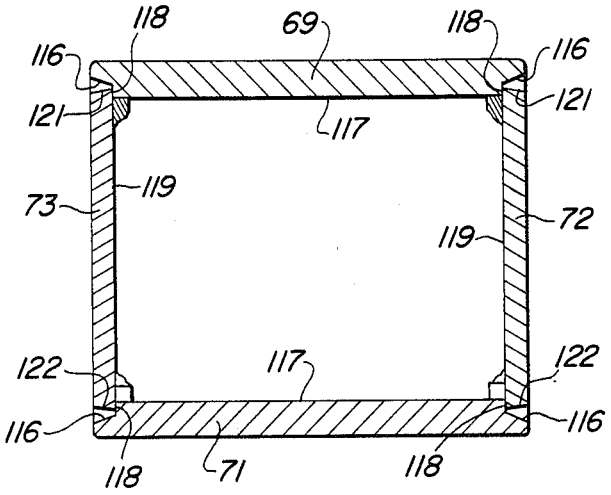
FIG. 6 is a section taken along line 6—6 in FIG. 5.

Referring to FIG. 6, a sectional taken through the box-like section of the center unit (52), which box-like section would be identical for the rear unit (51) with the exception of the vertical spacing between the upper and lower plates, it wil be seen that each upper and lower plate (69) and (71) has an angle surface (116) formed at each end thereof, forming thereby an inwardly extended shoulder portion (117) having a flat edge (118) at each end thereof. The transverse dimensions of the respective edges (118) for each upper and lower plate (69) and (71), respectively, are the same as the transverse inner width between the inner surfaces (119) of the side plates (72) and (73). It will be noted that the angle surface (116) for the upper plates (69) extend downwardly from the outer corners, whereas the angle cuts (116) for the lower plate (71) extend upwardly, all at an angle, as illustrated. To complete the formation of weld locations at each corner of the box-like structure of the center unit (52), as is the same case with the rear unit (51), a plasma cut process on the upper and lower edges of the side plates (72) and (73) produces an edge cut having approximately an eight degree angle which, in conjunction with the angle surfaces (116), and the proper width of the groove controlled by locating blocks attached to plates (72) and (73) contribute to a groove geometry which will give a full penetration weld in each corner of the box-like structure of the rear and center units (51) and (52), for maximum strength and durability. Furthermore, by this arrangement a continuous weld may be formed along the four corners of both the rear and center units (51) and (52), thereby eliminating weld start and stops which result in local high stress areas.

Figure 7:
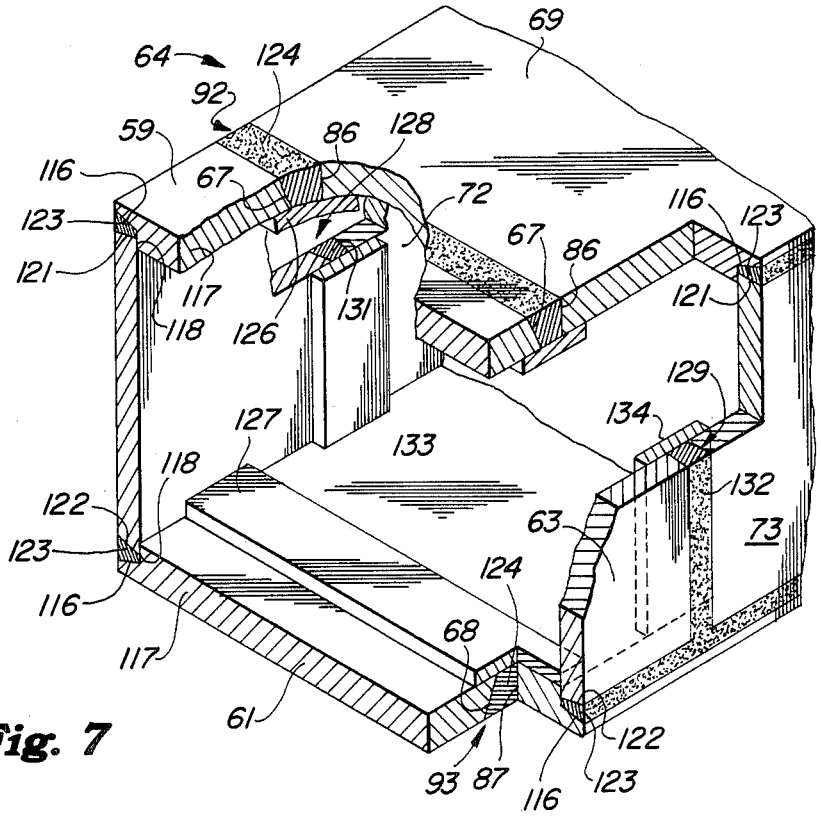
FIG. 7 is an enlarged perspective view, broken away for clarity of the weld juncture between the rear and center units of the main frame.

Referring to FIG. 7, the angle surface (116) and plasma cuts (121) and (122) for the upper and lower plates (59) and (61), respectively, and for the side plates (62) and (63) for the rear unit (51) again show the formation of weld spaces at the four corners of the box-like structure for the rear unit (51), substantially identical to that for the center unit (52). In FIG. 7, welds (123) are shown made at the four corners illustrated of both the rear and center units (51) and (52). Further, a weld (124) is shown formed in the upper and lower wedge-shaped spaces (92) and (93) (FIG. 4) for the upper plates (59), (69) and the lower plates (61), (71) for the rear and center units (51) and (52). Backing plates (126) and (127) are positioned to support welds (124) during the welding process. The joint between the rear unit (51) and the center unit (52) is completed at (64) by wedge-shaped weld spaces (128) and (129) being formed between adjacent ends of the side plates (62) and (63) for the rear unit, and (72) and (73) for the center unit (52), in the same manner as indicated hereinbefore, with welds (131) and (132) being formed in the spaces (128) and (120) respectively. Additionally, backing plates (133) and (134) are positioned to support welds (131) and (132) during the welding process as best illustrated in FIG. 7.

We claim:

1. A main frame for a motor grader vehicle having a wheeled engine frame articulately connected at the rear thereof, said main frame comprising:

an elongated unit including a rear unit for supporting an operator's station and a center unit secured together at adjoining ends, said rear unit and said center unit being in the form of a box section the entire length of said elongated unit, the transverse dimension of said elongated unit being substantially constant, said center unit having a location intermediate its ends, at which location, said center unit supports a saddle device having a ground engageable blade suspended therefrom, said center unit being free of structural strengthening means in addition to the box section for supporting the saddle device at said location, said center unit having a substantially constant outer transverse width at said location, said box section including pairs of opposed transversely extending and normally horizontally disposed bosses extending into said center unit at said location, said pairs of bosses being in longitudinally spaced relationship with respect to each other, and said saddle device mounted by pins to said pairs of bosses; and a front unit connected to the free end of said center unit and supported by ground-engageable wheels.

2. The invention of claim 1 and further wherein said box section of said rear and center units is comprised of upper and lower plates joined by transversely spaced side plates, and further wherein at the securement location of said rear and center units, free ends of said side plates of each of said rear and center units are spaced longitudinally apart from the free ends of said rear unit upper and lower plates, with weld material filling the spaces between said upper and lower plates of said respective rear and center units, and further wherein said securement location is spaced rearwardly and away from said saddle device mounting location on said center unit.

* * * * *